US005803845A

United States Patent [19]

Anderson

[11] Patent Number: 5,803,845

[45] Date of Patent: Sep. 8, 1998

[54] TIP ACTUATED ARROWHEAD

[76] Inventor: Jeffrey J. Anderson, 71 Ravine Lake Rd., Bernardsville, N.J. 07924

[21] Appl. No.: 865,581

[22] Filed: May 29, 1997

[51] Int. Cl.[6] ..... F42B 6/08

[52] U.S. Cl. ..... 473/583

[58] Field of Search ..... 473/582–585, 473/219–222; 43/6

[56] References Cited

U.S. PATENT DOCUMENTS

| | | | |
|---|---|---|---|
| 2,859,970 | 11/1958 | Doonan | 473/583 |
| 4,099,720 | 7/1978 | Zeren | 473/584 |
| 4,579,348 | 4/1986 | Jones | 473/583 |
| 4,932,671 | 6/1990 | Anderson, Jr. . | |
| 4,998,738 | 3/1991 | Puckett . | |
| 5,082,292 | 1/1992 | Puckett et al. . | |
| 5,172,916 | 12/1992 | Puckett . | |
| 5,322,297 | 6/1994 | Smith . | |
| 5,458,341 | 10/1995 | Forrest et al. | 473/583 |
| 5,564,713 | 10/1996 | Mizek et al. . | |

*Primary Examiner*—Mark S. Graham

*Attorney, Agent, or Firm*—Gibbons, Del Deo, Dolan, Griffinger and Vecchione

[57] ABSTRACT

An arrowhead for an arrow that utilizes a tip actuation mechanism for retaining and releasing a set of expandable blades. The arrowhead has a tip ferrule and a body ferrule, each having a number of blade slots. A set of blades, each having a blade ear, are rotatably attached to the body ferrule. The tip ferrule is positioned on the body ferrule such that the tip ferrule sits on each blade ear and retains the blades in a semi-retracted position. The downward force by the tip ferrule on the blade ear causes direct ejection of the blades without the use of any intervening structures. Consequently, the impact force is maximized to penetrate into the animal, therefore increasing the chances of getting a kill. The device can be reused by the user without the purchase of any new parts by simply attaching the tip ferrule to the body ferrule.

20 Claims, 1 Drawing Sheet

TIP ACTUATED ARROWHEAD

FIELD OF THE INVENTION

This invention relates to the field of archery and hunting, and in particular, to arrowheads with expandable blades.

BACKGROUND OF THE INVENTION

When hunting game with bow and arrows, the perfect arrowhead would be one that has the flight characteristics of a dart-type configuration and has the cutting ability of a bladed configuration. Although various prior art arrowheads attempt to provide both characteristics, the designs have limited penetration ability. Broadhead and expandable broadhead are two arrowhead categories that attempt to provide both characteristics.

A broadhead is an arrowhead that has an extended blade arrangement. As a consequence, arrows equipped with broadheads inflict more extensive damage to the target, for example, a deer. Although the extended blade arrangement has a greater chance of obtaining a kill upon impact with the target, the configuration is susceptible to the adverse effects of wind shear. Specifically, the wind acts on the extended blades to alter the flight of the arrow, thereby decreasing the accuracy of the arrow. Furthermore, the lack of an aerodynamic profile decreases the speed at which the arrow travels. The lack of speed translates into a decreased level of penetration into the target and decreases the chances of a kill with the extended blade arrangement.

Another group of prior art devices, expandable broadheads, attempts to solve the above problems by utilizing the concept of expandable blades. In general, the expandable blades are in a closed or semi-closed position during the flight of the arrow and expand radially outward from the arrow shaft upon impact with the target. Various designs and mechanisms for retaining and releasing the expandable blades are illustrated in the prior art. A drawback of these prior art designs is that they utilize complex mechanisms for retaining the blades during flight and releasing the blades at impact. For example, some prior art devices utilize spurs or side extensions to release the blades. In these devices, the spurs use the target skin as a pivoting surface to rotate the blades to the open position. Other prior art devices employ plunger mechanisms at the forward section of the arrow and camming surfaces near the back of the arrow to release the retracted blades. A disadvantage of this arrangement is that part of the force generated from the mass and acceleration of the arrow is transferred from the plunger to the blade and used against the camming surface. As a consequence of the above and the fact that most of these devices have multiple moving parts, a relatively substantial portion of the impact force is required to overcome the retaining mechanism. This redistribution of the force at the impact point results in decreased penetration of the target. This decreases the effectiveness of the arrow in inflicting damage to the target and in obtaining a kill. The complexity of the prior art devices makes use and reuse of these devices very difficult.

Accordingly, there is a need to provide a simple and effective mechanism which retains a set of blades in a closed position, yet requires minimal force to release the blades at impact with the target.

SUMMARY OF THE INVENTION

The present invention teaches a device that reduces the effects of wind and maximizes the utilization of the impact force by providing a tip actuated retaining and releasing mechanism. The effects of wind shear are minimized due to the semi-enclosed expandable blade design of the present invention. Importantly, the tip actuation mechanism is easy to use and reuse.

In an exemplary embodiment of the present invention, an arrowhead has a tip ferrule and a body ferrule, each having a number of blade slots. A set of blades, each having a blade ear, are rotatably attached to the body ferrule. The tip ferrule is positioned on the body ferrule such that the tip ferrule sits on each blade ear and retains the blades in a semi-closed position. Advantageously, the mechanism of the present invention causes direct release of the blades without any intervening structures. Consequently, the impact force is maximized to penetrate into the animal, therefore increasing the chances of getting a kill.

Importantly, the device of the present structure is reusable without the expense of new parts. The above factors make the present arrowhead a simple, accurate and effective device for hunting game.

BRIEF DESCRIPTION OF THE DRAWINGS

A more complete understanding of the present invention may be obtained from consideration of the following description in conjunction with the drawings in which:

FIG. 2(*a*) is a top view of a preferred arrow point utilized in the present invention;

FIG. 2(*b*) is an illustration of a preferred arrow point utilized in the present invention;

FIG. 3(*b*) is atop view of the embodiment shown in FIG. 3(*a*);

FIG. 4(*b*) illustrates the present invention in an open position.

DETAILED DESCRIPITON

The present invention is an arrowhead utilizing a retaining and releasing mechanism that maintains expandable blades in a semi-closed position during flight and advances rotation of the expandable blades to an open position when the mechanism impacts the target. The semi-closed blade position evinces a low aerodynamic profile during the flight of the arrow. As a consequence, the arrow flies true and maximizes the energy deposited at the impact point. Since the present design directly releases the expandable blades upon impact, a minimal portion of the impact force is needed in releasing the blades. This permits greater penetration into the animal and increases the chances of a kill.

Figure 1:
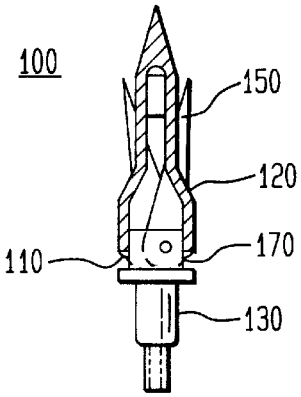
FIG. 1 is an exemplary embodiment of an arrowhead in accordance with the present invention.
Figure 2:
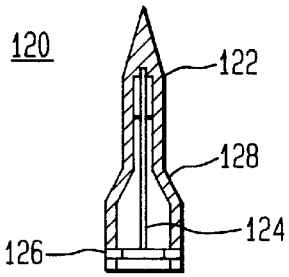
FIG. 2 is an exemplary embodiment of a tip ferrule in accordance with the present invention.
Figure 2A:
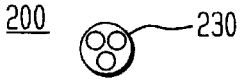

Referring to FIG. 1, there is shown an exemplary embodiment of an arrow 100 equipped with an arrowhead 110 in accordance with the principles of the present invention. Arrowhead 110 has a tip ferrule 120, a body ferrule 130, and a set of blades 150. As shown in FIG. 2, tip ferrule 120 has an arrow point 122, blade slots 124 and an internal o-ring 126. Tip ferrule 120 can be unistructurally constructed from various materials, including metals, composites and hard plastics. Alternatively, arrow point 122 and a tip ferrule body 128 could be coupled using a screw type mechanism or other similar attachment mechanism.

As stated above, arrow point 122 can be removably attached to tip ferrule body 128. As such, arrowhead 110 can use any standard arrow tip. Referring to FIGS. 2(*a*) and 2(*b*), an arrow point 200 has a cutting section 240 that has at least three or more sides that taper up from first wedge section 242 to form a point 230. Note that first wedge section could be a part of tip ferrule body 120. Cutting section 240 has at least a length of 1.1 times a diameter D of first wedge section 242. Preferably, the length of cutting section 240 is at least two times the diameter of first wedge section 242. By maintaining the above ratio, the lower profile cutting section 240 can penetrate deeper and easier into the tougher areas, e.g., bone and cartilage, before allowing secondary levels of wedging action to separate the bone and cartilage. That is, cutting section 240 provides both a cutting action and a first level of wedging action. This permits arrow point 200 to penetrate further into the animal at impact. First wedge section 242 represents a second level of wedging action and further enlarges the entry/exit pathway for the blood of an animal. First wedge section 242 may be a cone, cylinder or other tapered shaft that has a round or geometrically shaped cross-section. As stated above, the diameter of first wedge section 242 is D, where D represents a range of diameters, for example, 0.10" to 1". However, the diameter could be of any width, as long as the length of cutting section 240 is at least 1.1 times the diameter D. At an opposing end of first wedge section 242 is chamfer section 244, which has a diameter D at a first end 245 and a diameter of at least 1.1 times D at a second end 246. Chamfer section 242 also represents the starting of the third level of the wedging action.

Figure 3A:
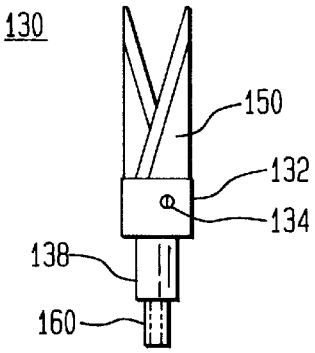
FIG. 3(*a*) is an exemplary embodiment of a body ferrule in accordance with the present invention.
Figure 2B:
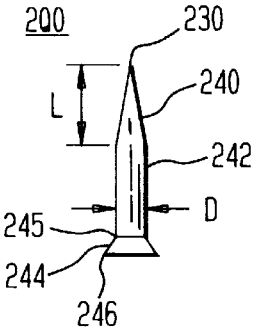
Figure 3B:
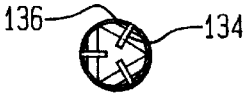

Referring now to FIGS. 3(*a*) and 3(*b*), body ferrule 130 has a ferrule 132, a screw 134, blade slots 136 and a shaft portion 138. Blades 150 are rotatably coupled to ferrule 132 using screws 134. Other attachment mechanisms could also be utilized in coupling blades 150 to ferrule 132. A shaft portion 138, which is used to connect arrowhead 110 to an arrow shaft 160, is coupled to ferrule 134 using conventional attachment mechanisms. In the exemplary embodiment of the present invention, arrow 100 has three expandable blades 150 rotatably coupled to ferrule 132. However, the number of blades 150, blade slots 124, and blade slots 136 is variable. Blades 150 are arranged on ferrule 132 such that the angles between each blade 150 are equal. For example, an arrow having three blades will have an angular separation of 120° between each blade and an arrow having four blades will have an angular separation of 90° between each blade. Referring back to FIG. 1, each blade 150 has a blade ear 170 for holding tip ferrule 120 when blades 150 are in the semi-closed or retracted position. Blade 150 has a generally right triangular shape, where the longest side represents faces outward. Blade ear 170 of blade 150 is at end adjacent to ferrule 132.

The structure of the present invention minimizes the number of parts involved in retaining and releasing blades 150. This permits a greater portion of the force to be applied in the forward penetrating direction. A further advantage of the present device is that no replacement parts are required for reuse of the arrowhead. An added value of the device, as illustrated below, is that the simplicity of the arrowhead translates to simplicity in operation.

Figure 4A:
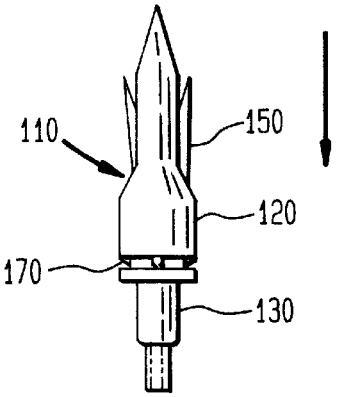
FIG. 4(*a*) illustrates the present invention in a closed position.
Figure 4B:
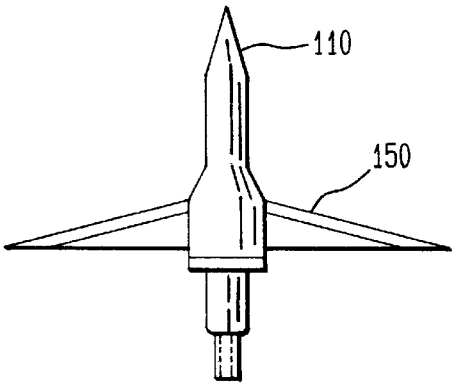

Referring to FIGS. 4(*a*) and 4(*b*), arrowhead 110 has a semi-retracted position and an open position, respectively. Tip ferrule 120 is fitted onto blade ears 170 to form the semi-retracted position. The position of tip ferrule 120 is maintained by internal o-ring 126 and the frictional contact between blades 150 and blade slots 124 in tip ferrule 120. The open position is better explained in terms of actual use and is detailed below.

Operationally, when the point of tip ferrule 120 contacts the object, tip ferrule 120 is forced back onto blade ears 170. As shown in FIG. 4(*b*), this action rotates blades 150 in an outwardly manner. Note that tip ferrule 120 works directly on blade ears 170 to pivot blades 150. As such, minimal energy is dissipated in the opening of blades 150 and permits greater penetration into the object, for example, an animal. As the arrow proceeds through the object, the tip shown in FIGS. 2(*a*) and 2(*b*) starts cutting and initiates the first level of wedging action. This enlarges the entry/exit pathway. Penetration, cutting and initial wedging continues until the first wedge section makes contact with the object. The action now becomes predominantly a wedging or splitting action that transforms the initially small entry/exit pathway into a larger diameter pathway. The lethality of the arrow and the chances of securing a kill are greater due to the present invention structure. If the user wants to reuse the arrowhead, the user simply needs to retract blades 150 and fit tip ferrule 120 onto blade ears 170. The above factors make the present arrowhead a simple, accurate and effective device for hunting game.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. Details of the structure may be varied substantially without departing from the spirit of the invention and the exclusive use of all modifications which come within the scope of the appended claim is reserved.

What is claimed:

1. An arrowhead adapted for penetration of an object, said arrowhead comprising:

a tip ferrule, said tip ferrule having at least two blade slots;

a body ferrule, said body ferrule having at least two blade slots; and at least two blades, said at least two blades rotatably coupled to said body ferrule;

each of said blades having a blade ear, wherein said tip ferrule is positioned on each said blade ear to retain said at least two blades in a closed position;

wherein said at least two blades go from said closed position to an open position when said arrowhead impacts said object, said tip ferrule pushing directly down on each said blade ear to cause said at least two blades to pivot outward.

2. The arrowhead according to claim 1, wherein said tip ferrule includes an internal o-ring.

3. The arrowhead according to claim 2, wherein said body ferrule includes a ferrule and a screw, said screw rotatably coupling said blades to said ferrule.

4. The arrowhead according to claim 3, wherein an angular separation between said at least two blades is equal.

5. The arrowhead according to claim 4, wherein said tip ferrule includes an arrow point, said arrow point including:

a first wedge section having a first diameter;

a cutting section having at least three sides tapering up from said first wedge section and terminating in a point; and a chamfer section having said first diameter at an end connected to said first wedge section and a second diameter at a second end.

6. The arrowhead according to claim 5, wherein said body ferrule includes a shaft for connecting to an arrow.

7. The arrowhead according to claim 1, wherein said tip ferrule includes an arrow point and a tip ferrule body.

8. The arrowhead according to claim 7, wherein said arrow point and said tip ferrule body are unistructurally formed.

9. The arrowhead according to claim 7, wherein said arrow point is coupled to said tip ferrule body.

10. The arrowhead according to claim 7, wherein said tip ferrule includes an internal o-ring.

11. An arrow adapted for striking an object, comprising:

a body ferrule;

a plurality of blades rotatably coupled to said body ferrule, each of said plurality of blades having a blade ear proximate to said body ferrule; and a tip ferrule, said tip ferrule resting on each said blade ear to maintain said blades in a semi-retracted position;

each of said tip ferrule and said body ferrule having a plurality of blade slots corresponding to said plurality of blades;

wherein said plurality of blades are released after said arrow impacts said object, said tip ferrule pushing directly on each said blade ear to cause outward rotation of said plurality of blades.

12. The arrow according to claim 11, wherein said tip ferrule includes an internal o-ring for maintaining position of said tip ferrule with respect to said body ferrule.

13. The arrow according to claim 12, wherein said tip ferrule includes an arrow point and a tip ferrule body, said arrow point being coupled to said tip ferrule body.

14. The arrow according to claim 11, wherein an angular separation between said plurality of blades is equal.

15. The arrow according to claim 14, wherein said body ferrule includes a shaft for connecting said body ferrule with an arrow shaft of said arrow.

16. An arrow having an arrowhead, said arrow for hunting game, comprising:

a body ferrule;

a plurality of blades rotatably coupled to said body ferrule, each of said plurality of blades having a blade ear proximate to said body ferrule; and a tip ferrule, said tip ferrule positioned on each blade ear for retaining said blades in a retracted position, wherein said tip ferrule and said body ferrule have a plurality of blade slots corresponding to said plurality of blades;

wherein said plurality of blades are released after said tip ferrule impacts said game, said tip ferrule placing direct downward force on each said blade ear, said direct downward force on each said blade ear causing said plurality of blades to pivot outward.

17. The arrow according to claim 16, wherein said tip ferrule includes an internal o-ring.

18. The arrow according to claim 17, wherein said body ferrule includes a screw for rotatably connecting said plurality of blades to said body ferrule.

19. The arrow according to claim 16, wherein said tip ferrule includes an arrow point and a tip ferrule body. said arrow point being coupled to said tip ferrule body.

20. The arrow according to claim 19, wherein an angular separation between said pluralitv of blades is equal.

* * * * *